United States Patent [19]

Wade et al.

[11] 4,150,651

[45] Apr. 24, 1979

[54] FUEL SYSTEM FOR INTERNAL COMBUSTION ENGINE

[75] Inventors: James A. Wade, Columbus; Edward D. Smith, Greensburg, both of Ind.

[73] Assignee: Cummins Engine Company, Inc., Columbus, Ind.

[21] Appl. No.: 865,463

[22] Filed: Dec. 29, 1977

[51] Int. Cl.[2] ..... F02M 63/02

[52] U.S. Cl. ..... 123/140 FG; 123/139 ST; 123/179 L; 123/198 F

[58] Field of Search ..... 123/140 FG, 139 ST, 123/179 L, 139 AZ, 198 F, 198 DB

[56] References Cited

U.S. PATENT DOCUMENTS

| | | | |
|---|---|---|---|
| 2,919,686 | 1/1960 | Mich | 123/198 F |
| 3,667,439 | 6/1972 | Muir | 123/140 FG |
| 3,741,685 | 6/1973 | Simko | 123/198 F |
| 3,896,779 | 7/1975 | Omou et al. | 123/198 F |
| 3,902,472 | 9/1975 | Baugelin | 123/198 F |
| 3,943,902 | 3/1976 | Skinner | 123/140FG |
| 3,976,042 | 8/1976 | Baguelin | 123/139 ST |
| 4,050,434 | 9/1977 | Zbikowski et al. | 123/139 ST |

*Primary Examiner*—Ira S. Lazarus

*Attorney, Agent, or Firm*—Gary M. Gron; Robert T. Ruff

[57] ABSTRACT

The disclosure illustrates a fuel control valve for a fuel system of a compression ignition engine which utilizes unit fuel injectors operating on the principle that the fuel pressure applied to the injectors determines the quantity of fuel injected into the engine cylinders. The fuel control valve is connected in the supply line for half of the injectors of the engine. The valve has a plunger which blocks off flow to these injectors whenever the fuel system pressure is below a predetermined level. When the pressure exceeds that level, the plunger displaces to a position where it permits flow to the injectors and offers a minimum restriction to flow. The pressure level is set at a level which reflects engine operation above idle but below normal engine operating conditions. The net effect is to substantially reduce the generation of white smoke during engine startup and while idling for extended periods of time while not affecting normal engine operating conditions. The selective termination of fuel to a portion of the cylinders has a beneficial effect on other engine emissions.

13 Claims, 3 Drawing Figures

Right Bank
Left Bank
14
56
16
22
12
10
26
60
58
24
18
28
62
108
72
70
114
112
68
76
74
72
102
104
106
94
92
86
82
80
96
100
98
88
84
90
30
110
54
34
32
52
50
40
42
44
64
20
46
38
48
36
116
42
40
66
37
CV

FUEL SYSTEM FOR INTERNAL COMBUSTION ENGINE

The present invention relates to fuel systems for compression ignition engines and more specifically to fuel control valves for such systems.

In the design of compression ignition or diesel engines, thought must be given to operation under cold start-up conditions. Since the diesel engine relies on the heat of compression of intake air to ignite a fuel air mixture, the introduction of cold intake air may not result in a sufficiently high temperature after compression. This is the reason that diesel engines require various devices to enable them to start under low ambient temperature conditions. Even after the engine has been started, problems arise because some of the fuel passes through the cylinder without being ignited due to erratic combustion conditions. This fuel passes out the exhaust of the engine in the form of a white cloud. This cloud consists of particles of unburned hydrocarbon and it may exist for a number of minutes after the engine has started.

One of the reasons for this occurrence is that during warm-up of an engine it is operating at an idle condition and under a very light load. As a result, the cylinder wall temperature and combustion chamber temperatures do not achieve the level found under normal operating conditions. One proposed solution to this problem has been to temporarily cut off fuel flow to certain of the engine cylinders in order to place the remaining cylinders under an increased load which raises temperatures sufficiently to minimize, if not eliminate, white smoke.

Certain fuel systems on the market incorporate what is known as unit injectors operating under the PT® principle. In this type of system the injectors have a cam activated plunger which injects fuel into the engine cylinder under high pressure. The quantity of fuel injected for each cycle is metered to the injector through an orifice. The pressure level of the fuel applied to the orifice of the individual injector is controlled by a fuel system which responds to operator demand and various operating parameters.

With a system of this type, it has been proposed in the past to selectively terminate fuel by means of a check valve located in the fuel lines leading to a portion of the engine injectors. While this system does selectively terminate flow and prevent white smoke, it has an adverse effect on the normal operation of the engine fuel system. The reason for this is that it imposes a constant pressure drop in the lines leading to the selected group of injectors. Since the system is pressure responsive this creates a power imbalance which must be compensated. Compensation may be achieved for one operating condition using an orifice for the remaining injectors. However, this does not help other operating conditions of the engine and it requires a recalibration and added complexity for the engine fuel system.

In accordance with the present invention, the above problems are solved by a fuel control valve for a system of the above general type. The valve means comprises a housing connected to the fuel system and having a flow path leading to the selected group of injectors. A plunger is displaceable between a first position blocking flow and a second position where it poses a negligible resistance to flow to the selected group of injectors. This plunger is urged towards the first position whenever the fuel pressure is below a given level and is urged towards the second position whenever the pressure is above this level. As a result, certain of the engine cylinders are motored during specified operating conditions to minimize engine exhaust emissions.

The above and other related features of the present invention will be apparent from a reading of the following description of the drawings and the novelty thereof pointed out in the appended claims.

Figure 1:
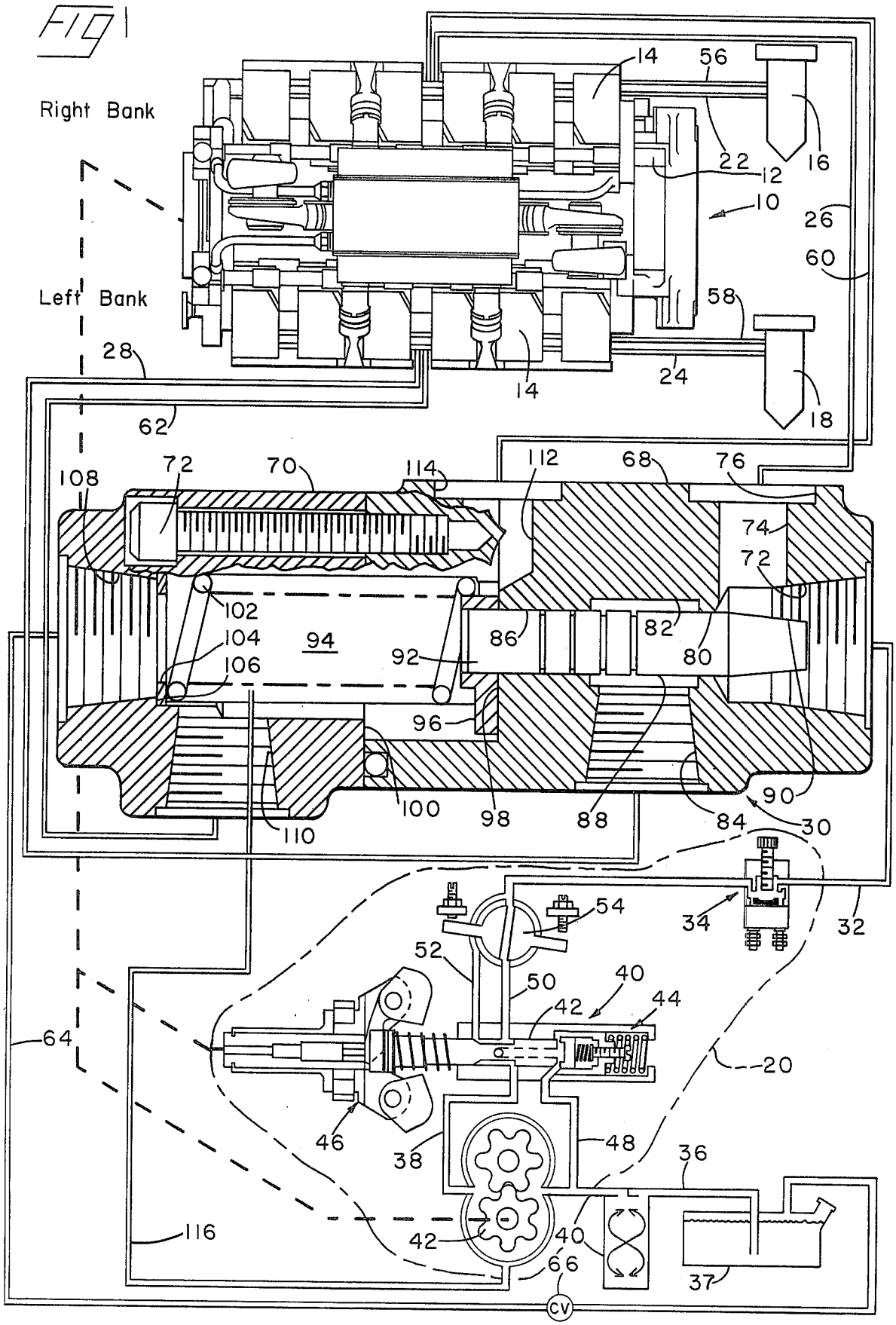
FIG. 1 is a longitudinal sectional view of a fuel control valve embodying the present invention along with a highly simplified illustration of an internal combustion engine and fuel system with which the valve may be used.

Referring first to FIG. 1, there is shown an internal combustion engine 10 of the V-type configuration. Engine 10 has a plurality of cylinder assemblies 14 (herein shown as 6 per bank) secured to a crankcase 12. Engine 10 has a crankshaft, connecting rod and pistons (not shown) which provide a rotary output. Engine 10 is of the compression ignition type which is more commonly referred to as a diesel engine. This type of engine relies on the heat of compression of intake air to ignite a combustible mixture resulting from injection of fuel into the cylinder when the pistons are at or near the end of their compression stroke. Ignition of the mixture reciprocates the pistons and thus causes the crankshaft to rotate.

Because of the above feature the fuel system for a diesel engine is a crucial component. The fuel system herein illustrated is known as the PT® fuel system manufactured and sold by the assignee of this invention. This system utilizes unit injectors for each cylinder. An example of such an injector may be found in U.S. Pat. No. 3,351,288. In order to simplify the description of the present invention, only two of these injectors 16 and 18 have been illustrated, the one injector being representative for those of the right bank and the other representative of those for the left bank of the engine looking toward the front of the engine. Injectors 16 and 18 each include, in their simplest form, a plunger which reciprocates in response to an engine driven cam actuation system to force fuel from a metering chamber into its associated cylinder in appropriate sequence. The quantity of fuel to the metering chamber is controlled by varying the pressure at an orifice which provides the entry to the metering chamber. This pressure is varied by the fuel system generally indicated at 20.

The pressurized fuel is carried to the injectors 16 and 18 by suitable passages or conduits 22 and 24. The passages 22 and 24 supply pressurized fuel to all the injectors of their associated bank of cylinders in parallel flow relationship. In other words the pressure in passageway 22 is substantially identical for all the injectors on the right bank of the engine. Pressure passages 22 and 24 connect with pressure passages 26 and 28 respectively. Pressure passages 26 and 28 lead to a fuel control valve 30 which will be described in detail below.

Fuel control valve 30 is supplied with fuel at a controlled pressure from the fuel system 20 via a line 32. A solenoid valve 34 permits all fuel flow to be positively terminated in response to an electrical input thus providing an on-off valve. Fuel is supplied to the fuel system 20 by a line 36 extending to a suitable fuel tank 37. Filter 40 is positioned in line 36 to prevent any contaminants from reaching the injectors. An engine driven gear pump 42 (not the mechanical connection) receives fuel from line 36 and pressurizes it for delivery through line 38 to a governor assembly generally indicated at 40. Governor assembly 40 includes a plunger 42 urged in one direction by a spring assembly 44 and in the opposite direction by engine driven fly weight assembly 46. The governor assembly 40 functions to variably restrict fuel flow to regulate engine idle R.P.M. and maximum R.P.M. It also acts to regulate fuel pressure at wide open throttle for intermediate engine R.P.M. by bypassing a selected portion of fuel to bypass line 48 leading to line 36 adjacent pump 42. The regulated pressurized fuel passes to line 32 either through line 50 and operator controlled throttle 54 or through idle passage 52. Throttle valve 54 permits the flow from governor assembly 40 to be throttled and to vary fuel pressure in response to operator demand except for fuel through the idle passage 52 which is controlled by plunger 42.

The fuel system decribed is of the type that requires a low pressure return line that carries back to the fuel tank 37 fuel not utilized by the fuel injectors 16 and 18. These return lines are indicated as lines 56 and 58 respectively. Passages 56 and 58 connect with passageways 60 and 62 respectively. Pasaageways 60 and 62 pass to the fuel control valve 30 and through internal passages to a drain line 64 leading to tank 37. A check valve 66 is positioned in drain line 64 and is set to open at a relatively low pressure such as 1 psi to insure that a quantity of fuel is maintained around the injectors 16 and 18 as will be described later.

The fuel control valve 30 comprises first and second housings 68 and 70 secured to one another by screws 72. Housing 68 has an inlet port 72 connected with line 32. A port 74 extends from inlet port 72 at right angles to an annular recess 76 for connection with pressure passage 26 for injector 16. Inlet port 72 connects with an opening 80 leading to a chamber 82 connecting with a laterally extending outlet port 84 connected with pressure passage 28.

Opening 80 is coaxial with an opening 86. A plunger 88 is received in openings 86 and 80 and has a first tapered end 90 exposed to inlet port 72 and an opposite end 92 positioned within a chamber 94. A retainer 96 is secured to end 92 of plunger 88 and is displaceable between end wall 98 of chamber 94 and a shoulder 100 to limit the displacement of plunger 88 between two positions. The first position, illustrated in FIG. 1, results in plunger 88 blocking flow through opening 80 and out of port 84. The second position is encountered when retainer 96 is against shoulder 100 and the plunger 88 is displaced sufficiently so that relatively unrestricted flow is permitted through opening 80 to port 84.

Plunger 88 is urged toward the illustrated first position by a coil spring 102 positioned within chamber 94 which is generally cylindrical in shape. Spring 102 acts on retainer 96 at one end and another retainer 104 at the opposite end. Retainer 104 is received against a shoulder 106 adjacent an outlet port 108 for chamber 94. The width of retainer 104 in the direction of the longitudinal axis of chamber 94 is predetermined to apply a given load to spring 102.

Outlet port 108 connects to drain line 64 and may be appropriately threaded. Another port 110 extends from chamber 94 and connects with return line 62 leading to injector 18. An additional port 112 extends from chamber 94 to an annular recess 114 for connection with return line 60 for injector 16. Still another connection is provided to chamber 94 by a line 116 extending from gear pump 42 to return fuel that passes through gear pump 42 for cooling purposes.

Figure 2:
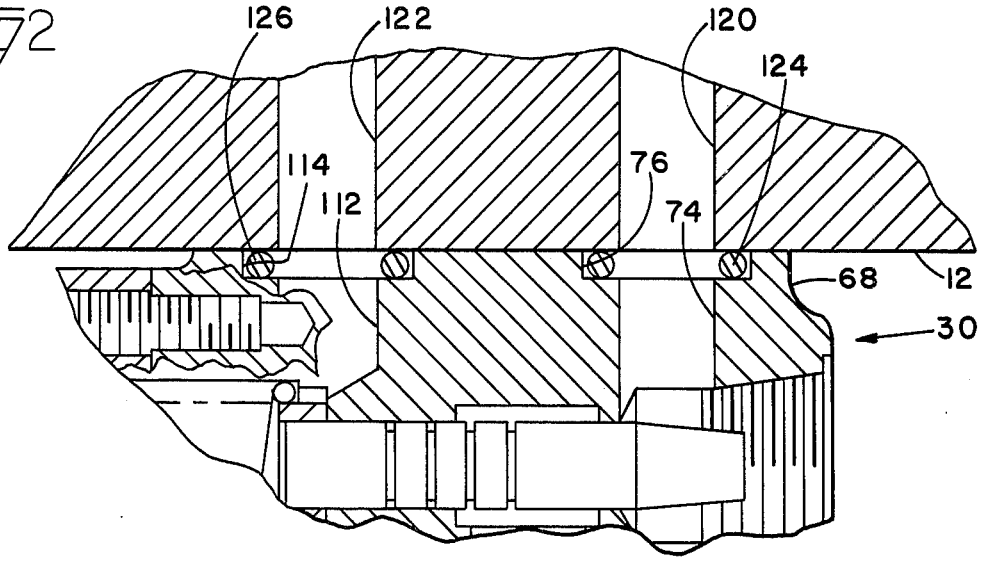
FIG. 2 is a fragmentary section view of the valve shown in FIG. 1 illustrating how it is physically attached to the internal combustion engine also shown in FIG. 1.

Fuel control valve 30 is shown in FIG. 1 with diagramatic connections to the fuel system of FIG. 1. As illustrated in FIG. 2, however, the valve 30 is shown in a typical actual installation where the valve functions to connect fuel passages of a V-type engine. In this figure, the fuel valve 30 is secured to the engine crankcase 12 by suitable fastening screws (not shown). Ports 74 and 112 align with holes 120 and 122 drilled through the block 12 from the side shown adjacent the left bank to the opposite side of the engine which is adjacent the right bank of the engine. Suitable "O" rings 124 and 126 in annular recesses 76 and 114 provide a seal. Thus it is seen that the fuel control valve 30 is adapted to be used with an engine having internal fuel passages to minimize external lines.

In operation, the fuel system 20 supplies a controlled pressure through line 32 which is applied to inlet port 72. This pressure is applied to injector 16 at all times but the pressure to injector 18 is connected only when the pressure in inlet 72 is above a predetermined level. When the pressure in port 72 is below this level no fuel gets to injector 18. As a result the cylinders on the left bank do not produce power and, therefore, are motored. Since the cylinders on the right bank are still receiving fuel, they have an increased load placed on them. As a result, the internal temperatures are sufficiently high to substantially minimize, if not eliminate, white smoke. When the engine 10 is to be operated under normal conditions, the pressure in line 32 is increased thus urging the plunger 88 to the left where it permits flow to port 84. Since the plunger is displaced away from the opening 80 sufficiently it offers a negligible restriction to flow and therefore does not effect the normal operating characteristics of the engine. It should be noted also, that the pressure in chamber 94 which acts as the reference pressure for plunger 88 is at a very low level such as 1 psi so that it does not have a significant effect on the opening pressure of plunger 88. In contrast, a check valve acts to maintain a constant differential pressure across itself and thus varies the downstream pressure as a function of the upstream pressure.

The predetermined opening pressure may be varied by selecting different retainers 104 to achieve an appropriate opening level. By way of example only, the opening pressure may be selected as 10 psi for a fuel system where the pressure produced by assembly 20 can increase up to 180 psi for maximum operation. The taper 90 on plunger 88 permits a controlled transition from one bank to both bank operation. The reason is that the pressure applied to injector 18 is increased over a range of fuel system pressures rather than increased in an abrupt fashion which results uncontrollable increases in engine power. The degree of taper is selected in conjunction with the spring rate and plunger diameter to achieve an optimum rate of increase of pressure at port 84.

The check valve 66 may be employed to maintain a minimum quantity of fuel adjacent injectors 16 and 18 so that injector cooling can be maintained. Fuel control valve 30, in addition to controlling fuel to one bank of the engine, can be used as a manifold to interconnect the various lines of the fuel system in order to simplify the network of fuel conduits. As illustrated, the chamber 94 acts to interconnect a number of the drain and return lines while the pressure lines are fed from the opposite end of housing 68. As noted in FIG. 2, the housing 68 may be secured to the engine block 12 in line with through passages to further simplify the fuel system.

Figure 3:
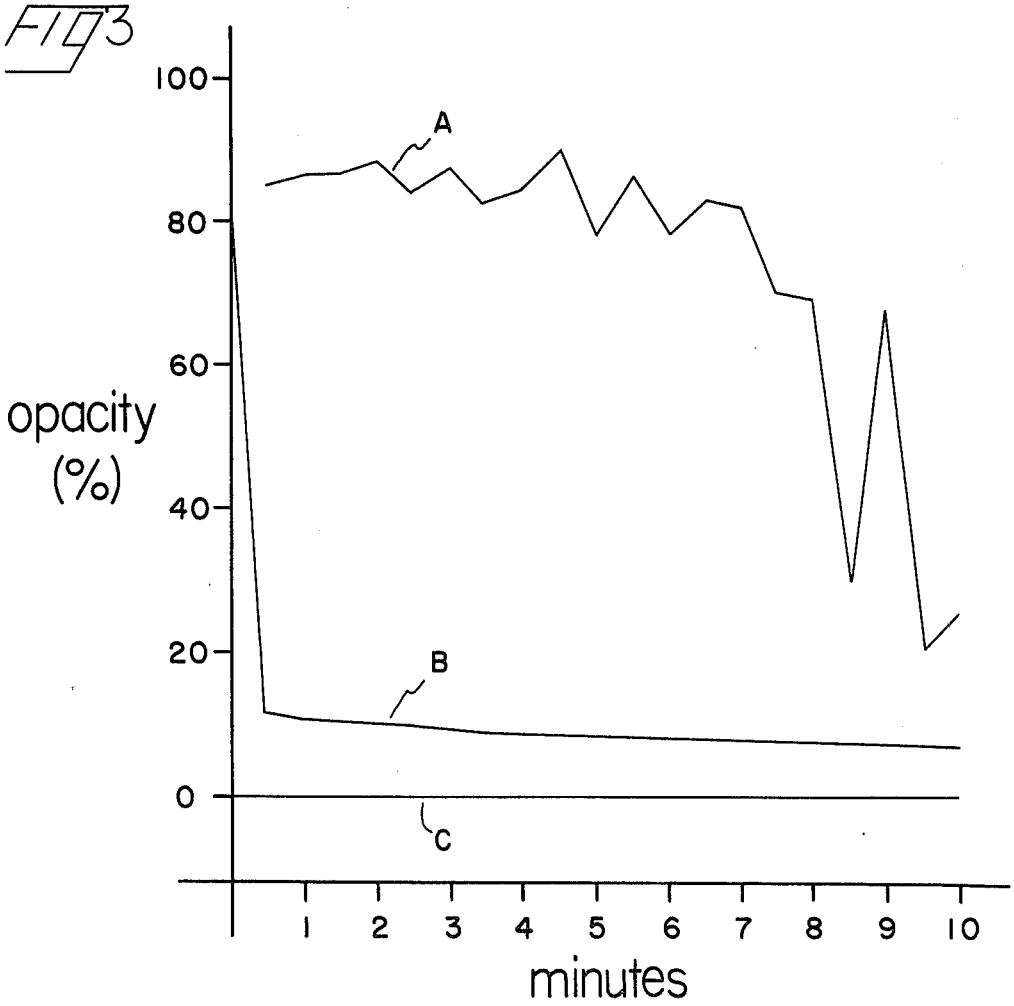
FIG. 3 is a graph of the opacity of the engine exhaust versus time for an engine not having the fuel control valve of the present invention in comparison with an engine having the fuel control valve.

The dramatic effect the fuel control valve has on white smoke is illustrated in FIG. 3 which shows the opacity of the engine exhaust as a function of time after a cold engine is started. Curve A illustrates opacity versus time for an engine that does not have the fuel control valve 30. It is quite evident that a substantial quantity of white smoke exists, even after a period of 8 minutes.

In contrast, curves B and C show the opacity of the exhaust from the right bank and the left bank of an engine having the fuel control 30. When fuel to the left bank is terminated the opacity of the exhaust from its cylinders will lie on curve C which has zero opacity. The cylinders of the right bank, which are continuing to fire, have a substantial load placed on them so that the opacity of the exhaust follows curve B where it quickly drops to a relatively low level. It should be noted also that fuel control valve 30 may be utilized to control other types of emissions.

Although a preferred embodiment of the present invention has been described, it should be noted by those skilled in the art that it can be practiced in other forms without departing from the spirit and scope thereof.

Having thus described the invention, what is claimed and novel and desired to be secured by Letters Patent of the United States is:

1. In a fuel system for a multicylinder compression ignition engine, said fuel system comprising a plurality of fuel injectors, one for each cylinder of said engine, said fuel injectors being adapted to inject fuel in timed sequence in quantities that vary as direct functions of pressure applied to the injectors, fuel pressurizing means for pressurizing a source of fuel to varying pressure levels as a function of operator demand and engine operating parameters, passageway means for connecting the output of said fuel pressurizing means to said fuel injectors, the improvement comprising a valve means interposed in said passageway means, said valve means comprising:

a housing having an inlet connected to said fuel pressurizing means and a flow path leading from said inlet to the passageway means supplying pressurized fuel to a portion only of the fuel injectors for said engine, a plunger displaceable between a first position wherein it blocks flow through said flow path and a second position wherein said plunger presents a negligible resistance to flow therethrough, said plunger providing a controlled rate of flow area increase between said first and second positions, means for urging said plunger toward said first position whenever the fuel system is below a predetermined level and for urging said valve toward said second position whenever the pressure is above said predetermined level, whereby a portion of the cylinders of said engine are motored during certain operating conditions to minimize engine exhaust emissions.

2. Apparatus as in claim 1 wherein said urging means comprises a spring acting on one end of said plunger to urge it toward said first position, the opposite end face of said plunger being exposed to pressure in said flow path adjacent said inlet, the area of the plunger end face and the spring loading being selected to achieve said predetermined pressure level.

3. Apparatus as in claim 2 wherein said one end of said plunger is exposed to a relatively low pressure.

4. Apparatus as in claim 3 wherein:

said fuel system has return passageway means for carrying excess fuel not utilized by said injectors to the source of fuel, said one end of said plunger is exposed to the pressure in said return passageway.

5. Apparatus as in claim 4 wherein:

said housing has a chamber receiving said one end of the plunger and said spring, said return passageway means is connected to said chamber.

6. Apparatus as in claim 5 wherein return said passageway means has a check valve set to open at a relatively low pressure to maintain a minimum quantity of fuel adjacent said fuel injectors.

7. Apparatus as in claim 6 wherein:

said chamber is generally cylindrical, has a shoulder at one end, and said one end of the plunger translates generally along the longitudinal axis of said chamber, said spring is a coil spring acting on one end of the plunger, said valve means further comprises a retainer of given dimension in the direction of the axis of said chamber acting against said shoulder, the other end of said spring acting on the retainer whereby the predetermined pressure may be adjustably selected.

8. Apparatus as in claim 1 wherein said valve means controls flow of fuel to half of the total cylinders of said engine.

9. Apparatus as in claim 1 wherein said predetermined pressure is selected to be the fuel system pressure occurring above idle and below normal engine operating pressures.

10. Apparatus as in claim 1 in combination with an engine of the V configuration having two banks of cylinders secured to a crankcase and wherein:

the passageway means includes at least one passage formed through said crankcase from one side of the engine to the other, said housing has an opening connected with said inlet and aligned with said passage on said one side;

said valve means further comprises means for releasably securing said housing to said engine crankcase.

11. Apparatus as in claim 10 wherein said opening in said housing is directly connected to said inlet so that the fuel flow is controlled to the bank on said one side of the engine.

12. Apparatus as in claim 11 wherein said fuel system further comprises return passageway means for carrying excess fuel not utilized by said injectors to the source of fuel and wherein:

said return passageway includes a return passage formed through said crankcase from one side of the engine to the other and adjacent said passage:

said housing has an opening connected to a low pressure on said one side.

13. Apparatus as in claim 1 wherein:

said plunger is displaceable into an opening for said first position;

said plunger has a tapered end portion that is withdrawn from said opening as said plunger is urged toward said second position, the degree of taper of said plunger being selected to provide a controlled flow area change at said opening.

* * * * *